United States Patent [19]

Place et al.

[11] 4,002,003

[45] Jan. 11, 1977

[54] METHOD FOR SECURING ARTICLES TO A DISPLAY BOARD

[75] Inventors: Osmund V. Place, Hudson; Hungerford, Jr., Philip C., Cleveland Heights; John L. Gereby, Wickliffe, all of Ohio

[73] Assignee: Cardpak Incorporated, Cleveland, Ohio

[22] Filed: May 27, 1975

[21] Appl. No.: 581,023

Related U.S. Application Data

[62] Division of Ser. No. 412,907, Nov. 5, 1973, Pat. No. 3,885,373.

[52] U.S. Cl. ..... 53/14

[51] Int. Cl.[2] ..... B65B 1/04

[58] Field of Search ..... 53/3, 14, 32, 137, 196; 206/459, 460, 461, 462, 463, 478, 479, 480, 482, 486, 813, 464, 476

[56] References Cited

UNITED STATES PATENTS

| | | | |
|---|---|---|---|
| 2,387,639 | 10/1945 | Bouchelle | 206/482 X |
| 2,971,306 | 2/1961 | Phillips | 53/137 |
| 3,061,091 | 10/1962 | Wickman | 206/462 |
| 3,135,384 | 6/1964 | Cozzolino | 206/460 |
| 3,394,802 | 7/1968 | Hershaft | 206/461 X |
| 3,698,551 | 10/1972 | Tomlinson | 53/14 X |
| 3,796,019 | 3/1974 | Swezey | 53/196 X |

FOREIGN PATENTS OR APPLICATIONS

| | | | |
|---|---|---|---|
| 411,993 | 6/1934 | United Kingdom | 206/460 |

*Primary Examiner*—Travis S. McGehee
*Assistant Examiner*—John Sipos
*Attorney, Agent, or Firm*—Hamilton, Renner & Kenner

[57] ABSTRACT

Disclosed is an apparatus and method for the packaging of salable articles. The articles to be packaged are placed within spaced holders carried by an endless belt which advances the article through the apparatus while various operations are being performed thereon. A drive mechanism advances and periodically interrupts movement of the endless belt and operates a display card transfer mechanism. Movement by the transfer mechanism is in two directions, vertically, to pick up a display card from a supply and subsequently place it in juxtaposition to the article in the holder, and horizontally whereby a display card is transferred from the supply to a position over the conveyor belt and holder. Simultaneous with the placement of the display card in juxtaposition to the article, one or more labels are applied to an article and display card positioned in another holder to form a package. At least one of the labels is preformed in order to better conform to the contours of the article and display card. When movement of the conveyor belt resumes, beginning another cycle, a completed package is emitted from the holder, another display card is transferred from the supply and one or more labels are prepared, both card and labels to be applied to different holders during the next interruption in the movement of the endless belt.

6 Claims, 19 Drawing Figures

59
43
44
42
186
188
194
183
168
181
160
182
180
4
4
45
22
203
259
21
5
5
162
356
342
43
46
41
20
359
40

58
44
46
47
48
49
50
51
52
53
54
55
56
43
60
61
63
64
65
66
68
69
70
71
72
73
74
75
78
79
80
81
82
84
85
86
88
89
90
91
92
93
94
95
98
99
101
102
103
104
108
113
114
115
116
118
119
120
121
123
124
126
150
151
152
153
154
155
156
158
159
160
161
168
200
202
208
209
210
211
302
350
352
353
356

METHOD FOR SECURING ARTICLES TO A DISPLAY BOARD

CROSS REFERENCE TO RELATED APPLICATIONS

This application is a division of application Ser. No. 412,907, filed Nov. 5, 1973, now U.S. Pat. No. 3,885,373.

BACKGROUND OF THE INVENTION

Concepts of packaging small goods including household products and personal items have been steadily changing from the day when most of the goods were sold in closed containers particularly cardboard boxes and paper wrappers. Packages are necessary for several reasons some of the more common ones being, to protect the product during shipment and subsequent display prior to the time of purchase by the consumer, to advertise the goods and to prevent tampering with the product by unauthorized persons.

Many products are also sold without the aid of packages because they are of such a nature that the consumer generally wishes to inspect them, or simply because they do not require protection or any appreciable amount of advertising. While lack of packaging represents a savings to the manufacturer, the retailer is often plagued with the theft of such goods, which include lipstick containers, ballpoint pens, spools of thread, combs, small toys and the like. One of the remedies to the theft of small items that has evolved has been effected by mounting the small product on a larger display card of a fairly rigid cardboard which increases the difficulty of inconspicuous theft.

The display card method of packaging also places the product in full view of the consumer and again provides the manufacturer the space for advertising. Most of the packages include a display panel of cardboard or similar material upon which may be printed product information, advertisement and directions. The article is placed upon the card and then affixed thereto by selecting a suitable method such as completely enveloping the article and display panel with a layer of clear plastic which may be either rigid or a flexible film.

In the interest of minimizing packaging material and labor, one method utilizes the label, normally affixed to the article, as the means for fastening the article to the display panel. The label, which is preferably self-adhesive, may be imprinted with directions or other desired information and is affixed directly to the article and display panel as though the article were being taped to a card. Following purchase, the consumer simply removes the article from the display panel and discards the latter.

While the foregoing procedure represents a significant departure from other methods, made more costly by the type of materials used, due to the number of steps involved and the apparatus required to perform the operations, it has not been found possible to apply the labels to the article and display panel in a proper manner. The chief difficulty experienced is due to the fact that most of the articles are thicker than the panel and when the label is applied it does not follow the contours of the article and the card but has a tendency to contact the highest surface of the article and then the card leaving a span or web between the two where the label is contacting neither surface. The web not only weakens the union between the article and panel, but also decreases the adherence of the label to the article upon removal from the panel. This troublesome occurrence becomes more frequent when the attempt is made to subject the packaging process to techniques of high speed automation.

SUMMARY OF THE INVENTION

It is therefore an object of the present invention to provide a method and apparatus for packaging an article by mounting it on a display card in full view, with adequate space for advertisements, directions and other information.

It is another object of the present invention to provide a method and apparatus for packaging an article which is held on a display card by the use of one or more labels.

It is yet another object of the present invention to provide a method and apparatus for packaging an article with a display card larger than the article thereby reducing the ease with which the article may be pilfered.

It is a further object of the present invention to provide a method and apparatus for packaging an article on a display card with one or more labels in such a manner that the labels remain permanently affixed to the article when the latter is intentionally separated from the card.

It is a still further object of the present invention to provide a method and apparatus for packaging an article utilizing a minimum amount of materials and a minimum number of operations so as to be nearly totally automated with a corresponding savings in time and labor.

These and other objects, together with the advantages thereof over existing and prior art forms, which will become apparent from the following specification are accomplished by means hereinafter described and claimed.

In general, an apparatus embodying the concept of the present invention and operable according to the method thereof, for packaging articles involves the placement of the article to be packaged upon a conveyor belt having spaced holders for the receipt thereof. A supply of display cards are stacked adjacent the conveyor belt and a transfer mechanism removes a card from the supply and deposits the card in juxtaposition to the article as it advances upon the conveyor belt.

A conventional label applying machine is adapted to prepare and apply labels to the article and display card and includes a label pick-up head to remove labels, preferably from two stacks, and to deposit them in a specially shaped tray wherein at least one of the labels is preformed in a manner hereinafter described to insure proper positioning of the label over the article and display card. A label transfer head is heated for use with heat sensitive labels and removes the labels from the preforming tray and deposits them onto the article. Movement of the conveyor belt is intermittantly interrupted to allow positioning of the labels upon the article. As the label transfer head withdraws from the article, a vertically displaced label applicator is driven down over the momentarily motionless conveyor belt to affix both labels completely to the article and display card. As the label applicator withdraws, the conveyor belt resumes movement, the packaged article is emitted therefrom and another packaging cycle is performed.

A preferred embodiment of apparatus suitable for practicing the method of the present invention to package an article is shown by way of example in the accompanying drawings and described in detail without attempting to show all of the various forms and modifications in which the invention might be embodied; the invention being measured by the appended claims and not by the details of the specification.

DESCRIPTION OF THE PREFERRED EMBODIMENTS

Figure 18:
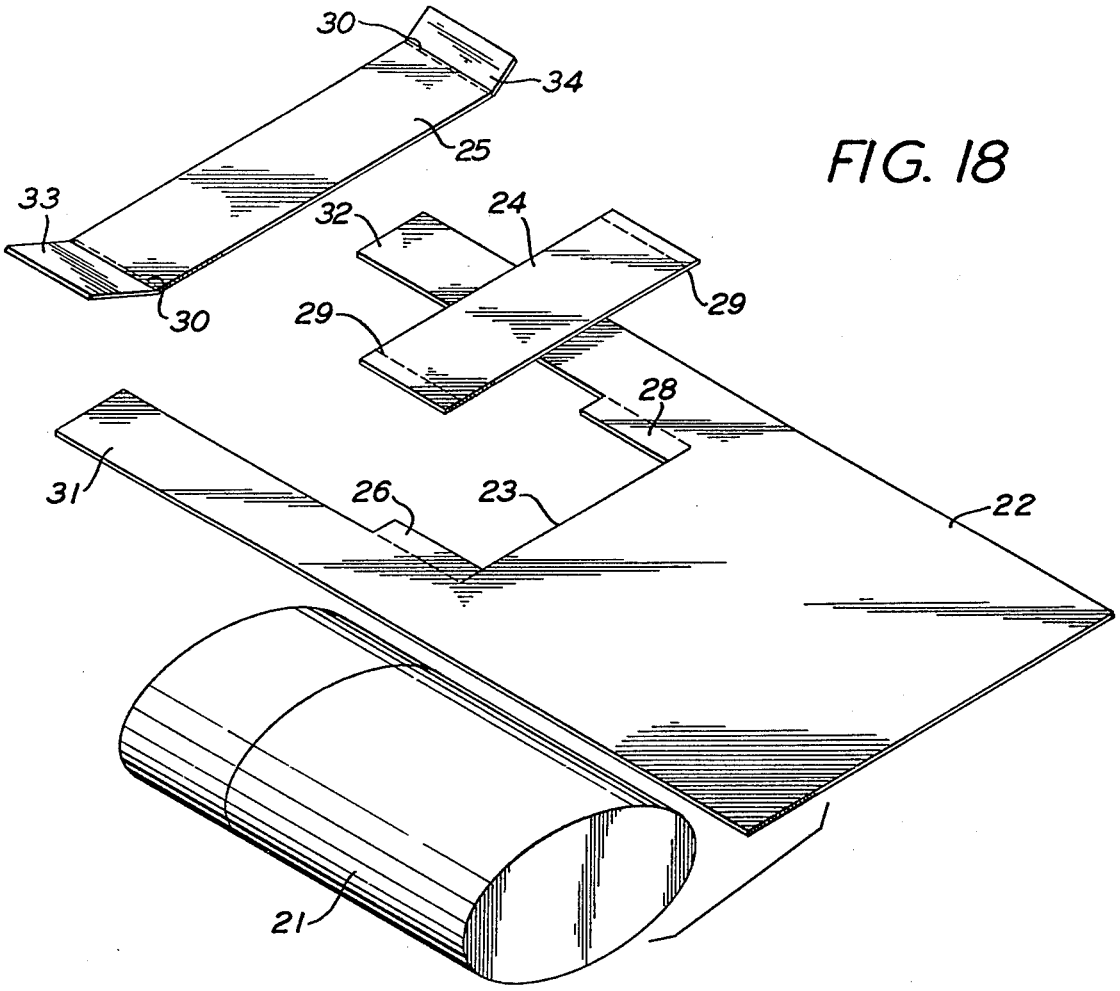
FIG. 18 is an exploded perspective view of the type of packaging according to the preferred method, depicting an article, a display card to be placed thereover and two labels to join the article to the display card; and, FIG. 19 is a perspective view of the finished package depicting the relative position of the article to the display card and the adjoining labels.
Figure 19:
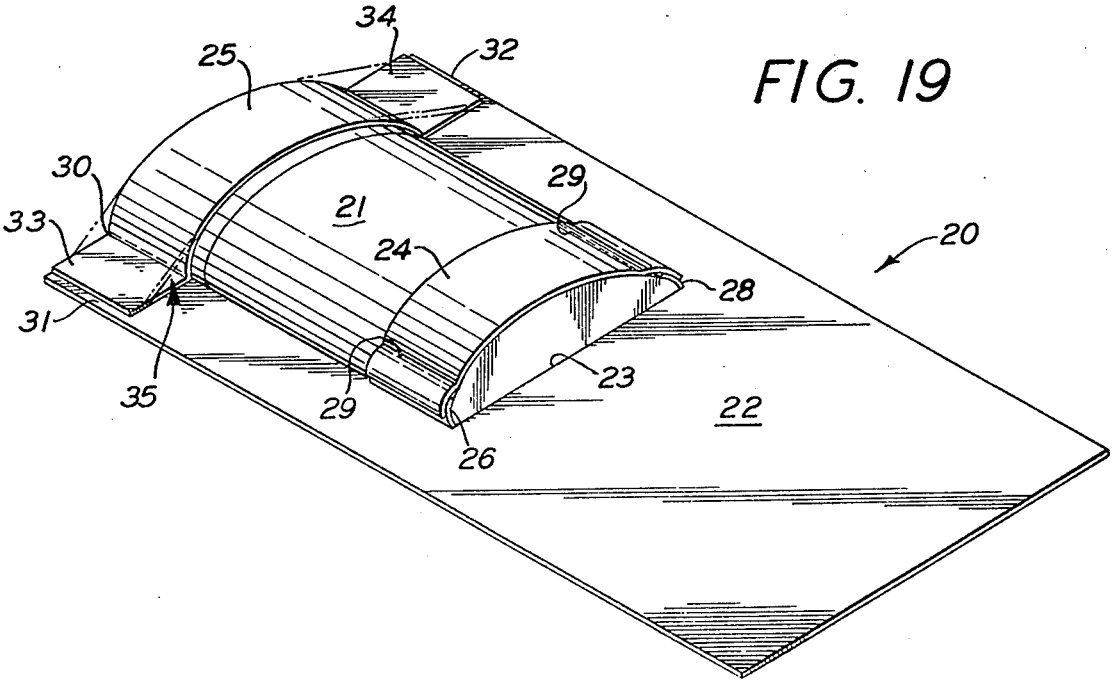

Referring more particularly to the drawings, a display package, indicated generally by the numeral 20, is depicted in FIGS. 18 and 19 and is representative of the type of package which may be prepared by the subject apparatus and according to the subject method. The display package 20, includes an article 21 of any conventional size and shape, a display card 22 of stiff paper, plastic, thin metal or other suitable material, generally larger than the article and having a cut out portion or opening 23 which approximately corresponds to the outline of the article 21, and one or more labels 24 and 25 joining the article 21 and display card 22 together.

It will be noted that the display card 22 has two tabs 26 and 28 extending into the opening 23. As the display card 22 is placed over the article 21 the tabs 26 and 28 are raised and tend to grip the article 21. Although not illustrated, other shapes and sizes of display cards may be utilized, and selection of a suitable one will generally be made with respect to the size, shape and weight of the article. Thus, if the article is relatively heavy, the tabs 26 and 28 may extend along the entire side thereof, or a tab forming a base may be provided at the bottom of the display card. Moreover, if the article has a flat side, it may be desirable to utilize a solid display card placing the article thereon and subsequently applying one or more labels to both. It is therefore within the scope of the present invention to utilize articles and display cards having sizes and shapes other than as depicted in FIGS. 18 and 19. Furthermore, although the display cards lie in juxtaposition to the articles, they may or may not actually contact one another. Nor is it imperative that the display card always be placed over or around the article, inasmuch as some layouts may require initial placement of the display card followed by deposit of the article thereon.

According to the preferred method for preparing the display package 20, as described herein, the display card 22 is placed in juxtaposition to the article 21. Both labels 24 and 25 are perforated as at 29 and 30 to aid the user in separating the article 21 from the display card 22 leaving labels 24 and 25 on the article. The label 24, which has a heat sensitive adhesive backing, preferably attaches to tab 26, to a portion of the article 21 and to tab 28. Label 25, also having a heat sensitive adhesive backing, adheres directly to the flat surface of the card, as at 31, over the article 21 and back to the card, as at 32. It has been found advantageous to preform the label 25 by creasing both ends, as at 33 and 34, to insure complete contact by all surfaces of the label 25 with the article 21 and the display card 22. Otherwise, the label 25 has a tendency to form a web by spanning the distance between the article 21 and the display card 22, generally indicated in chain lines in FIG. 19. Such webbing not only weakens the union between the article 21 and display card 22 but also permits the label 25 to pull away from the article 21 after removal from the display card 22.

Figure 1:
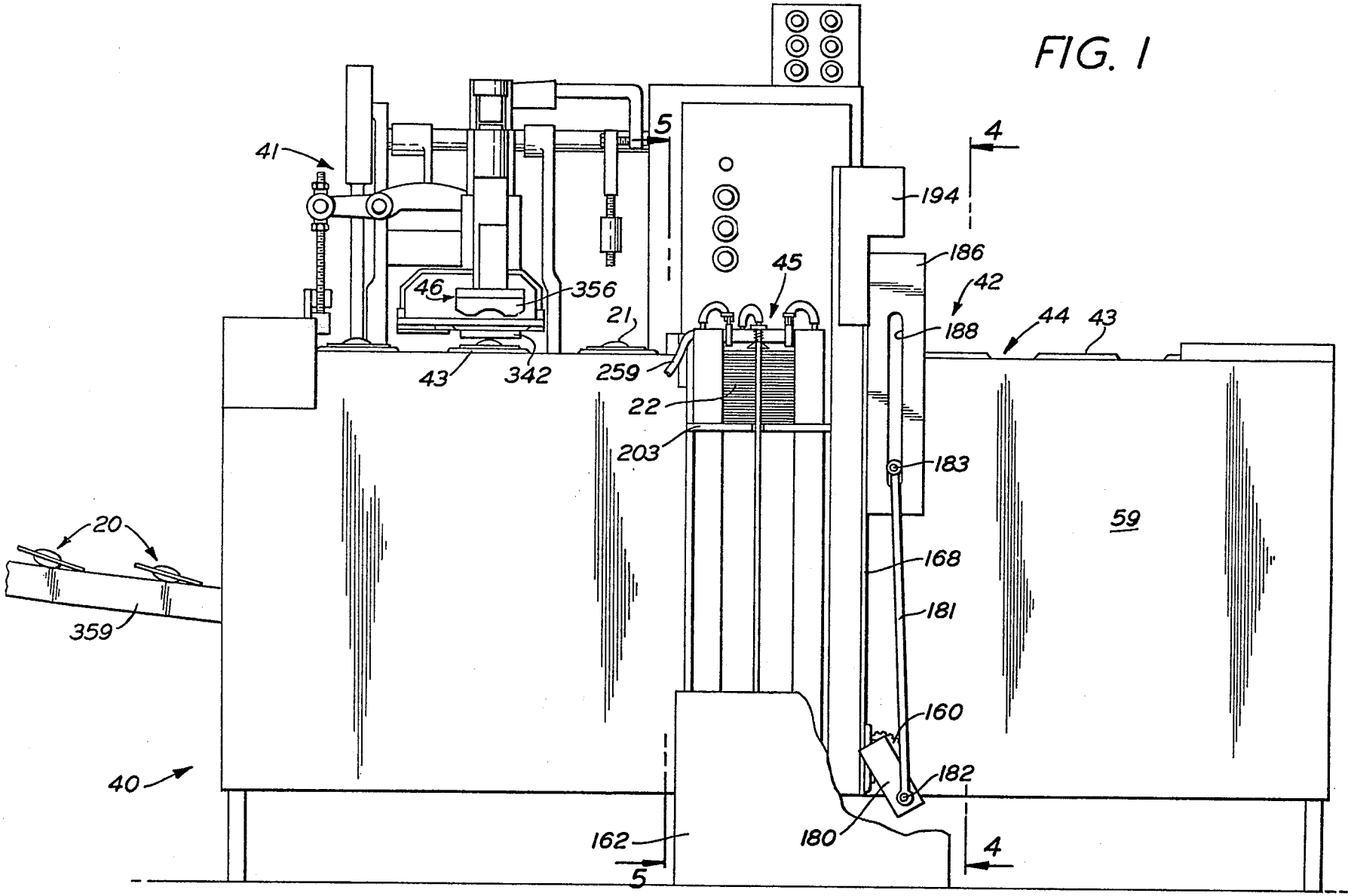
FIG. 1 is a front elevation of an exemplary apparatus embodying the concept of the present invention and suitable for packaging articles by mounting them in juxtaposition to display cards with labels, all according to the method thereof.

An overall view of one preferred form of apparatus embodying the concept of the present invention is depicted in FIG. 1 and identified generally by the numeral 40. The apparatus 40 includes a conventional dry labelling machine such as the New Jersey Pony Label-Dri 250 model, which has been somewhat modified and identified generally by the numeral 41, and the mechanism for positioning and feeding the articles 21 and display cards 22 thereto, identified generally by the numeral 42.

During processing of the package 20, the article 21 is placed in a tray holder 43 forming part of a conveyor belt generally 44. As the article advances, a display card transfer mechanism 45 places a display card 22 in juxtaposition to the article 21. Subsequently, a label applicator 46 from the labelling machine 41 affixes labels 24 and 25 to the article 21 and display card 22.

Figure 2:
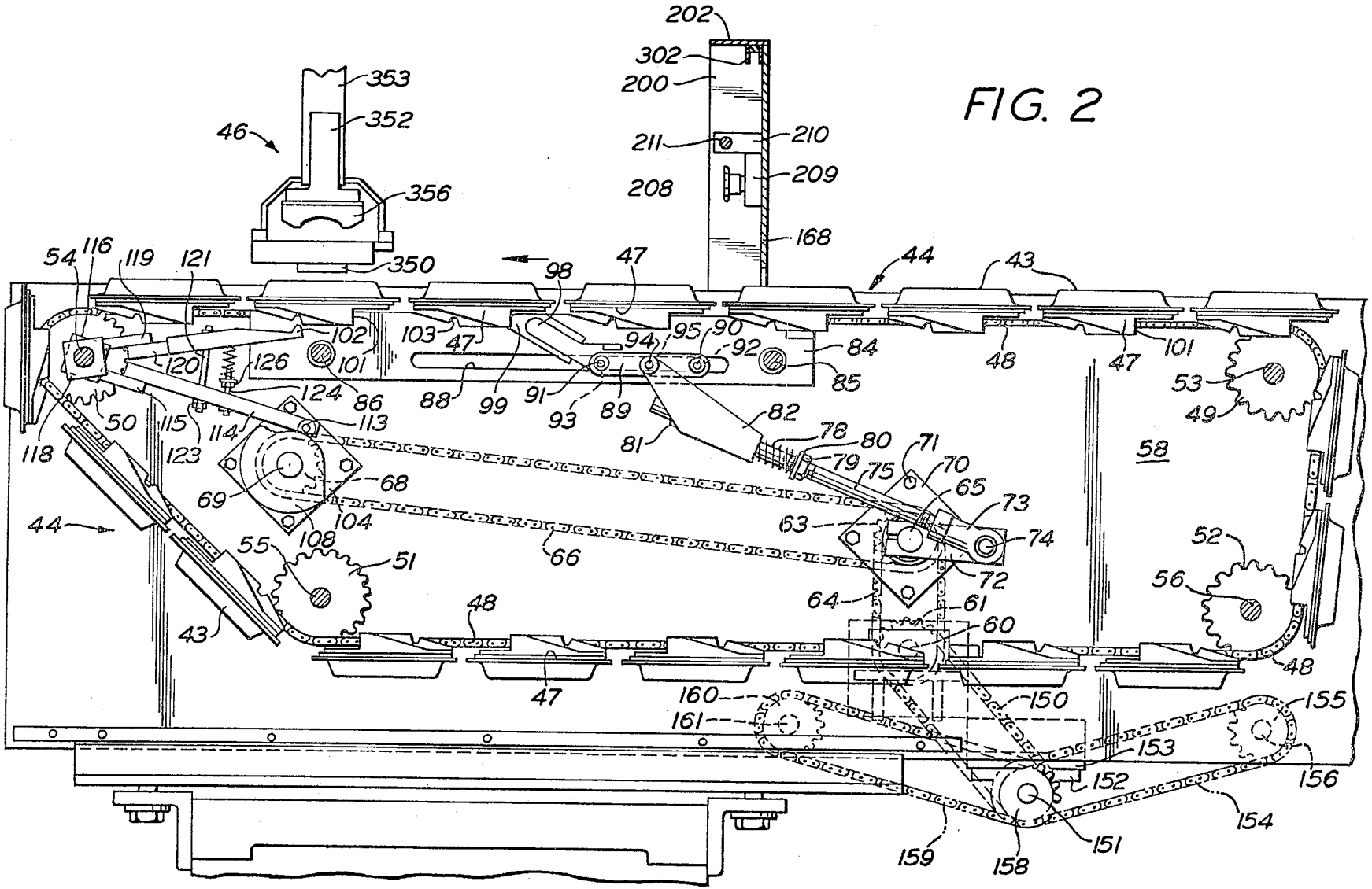
FIG. 2 is a front elevation of a portion of the apparatus represented in FIG. 1, with the front cover removed showing the sprocket and chain drive train.
Figure 3:
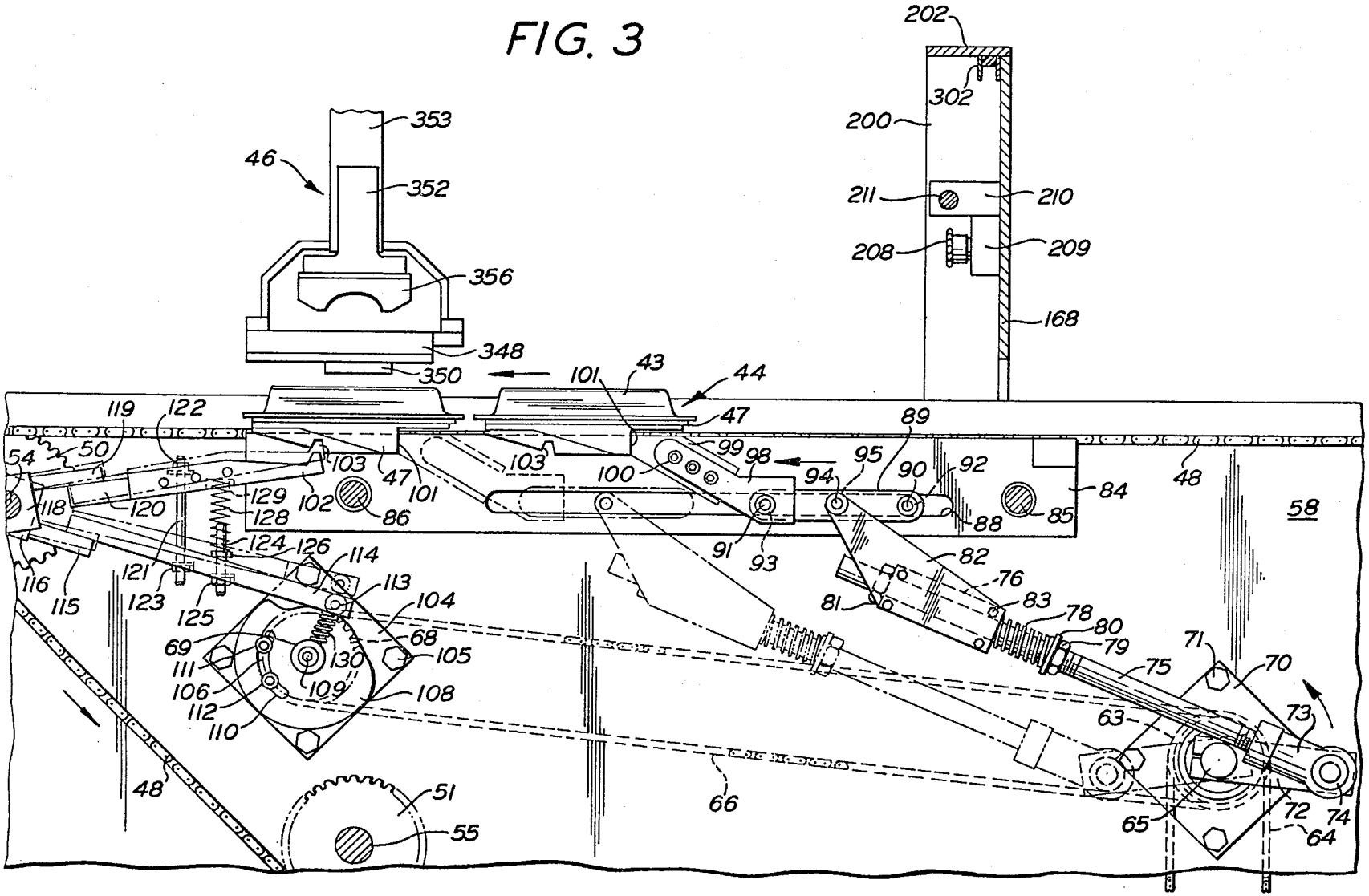
FIG. 3 is an enlarged front elevation similar to FIG. 2, depicting the mechanism for interrupting movement of the conveyor belt.
Figure 5:
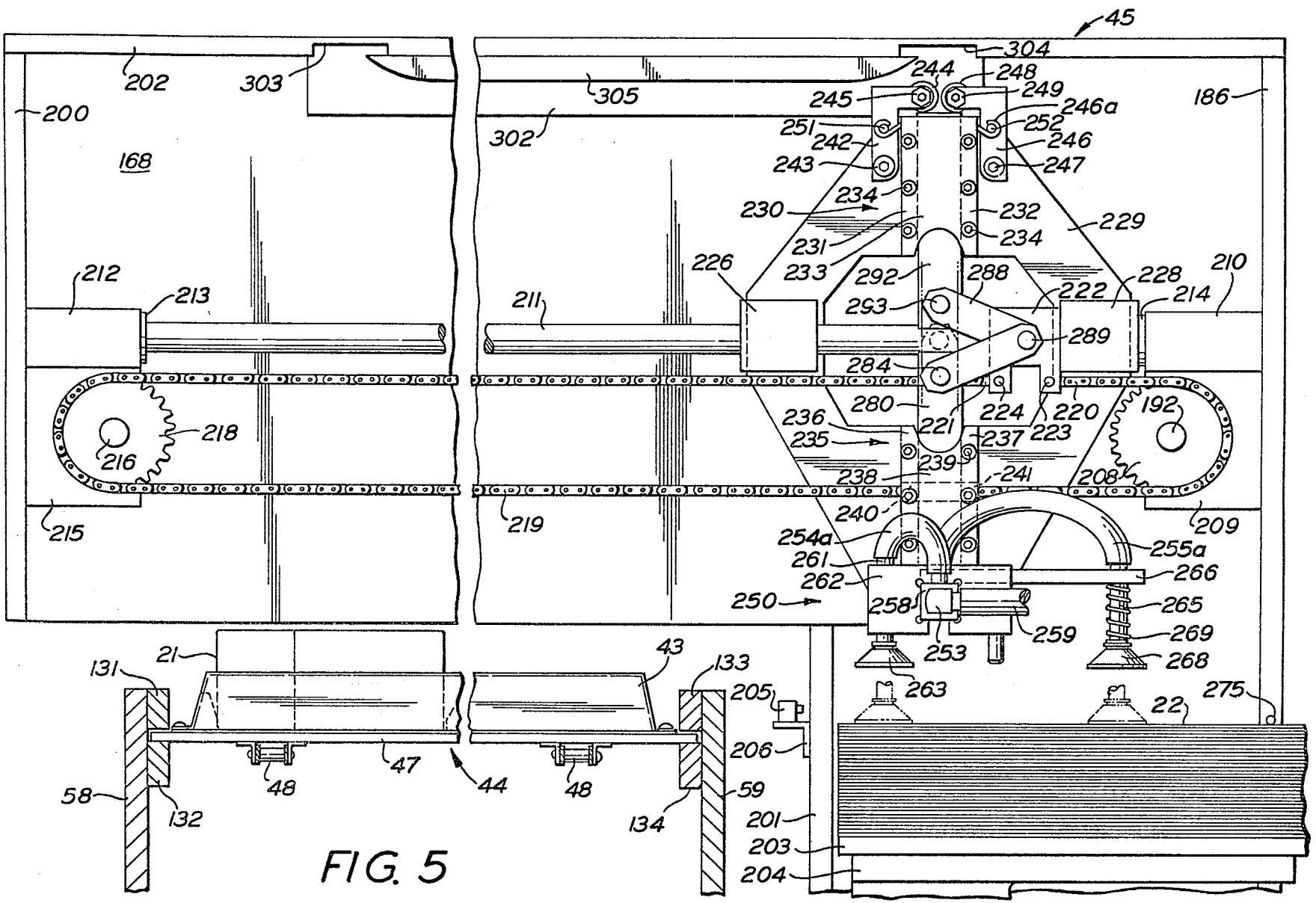
FIG. 5 is a side elevation taken substantially on line 5—5 of FIG. 1 depicting the front side of the display card transfer means represented in FIG. 4 and particularly depicting the head of the transfer means in position to remove a discard card from a stack of such cards.
Figure 6:
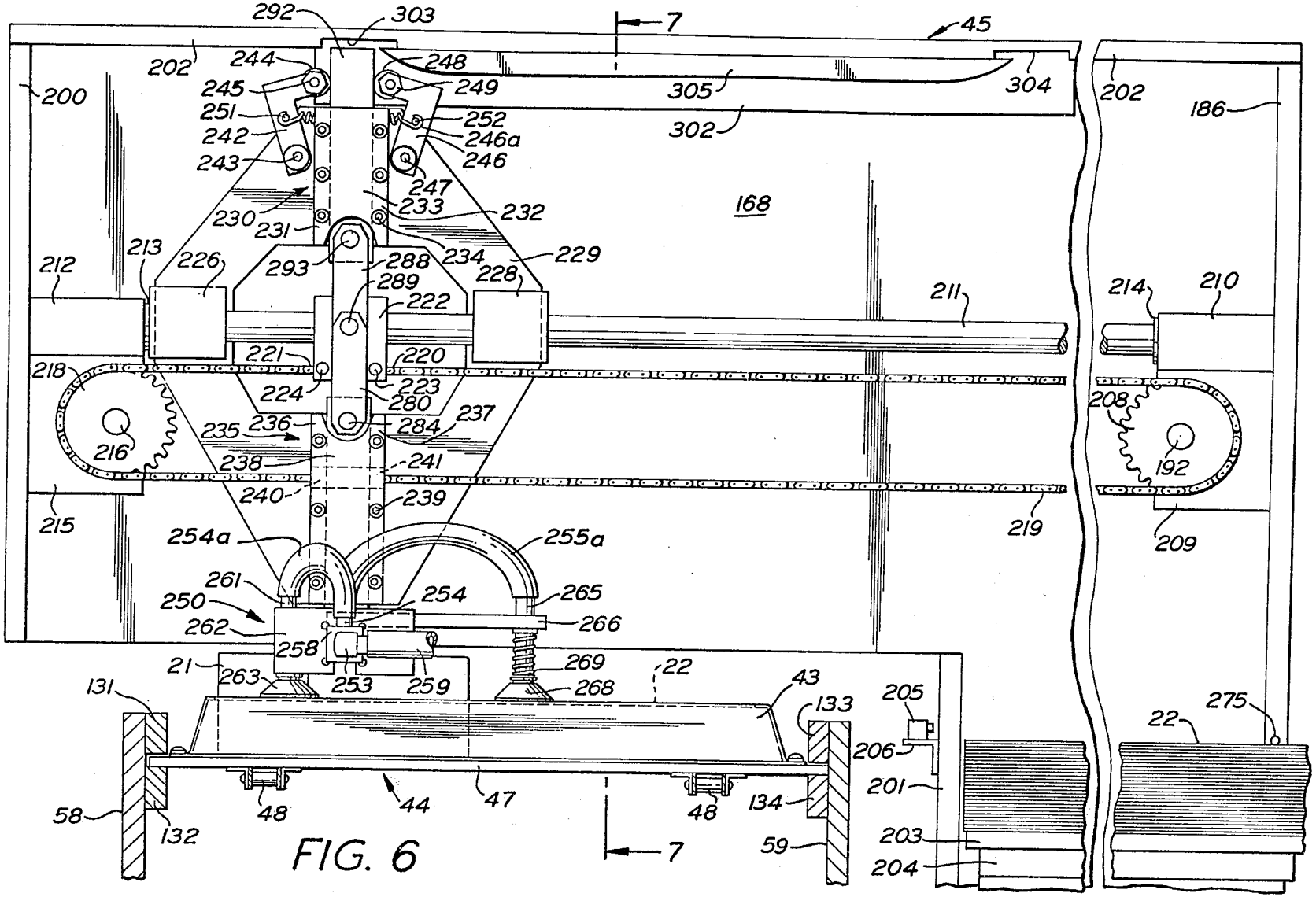
FIG. 6 is a side elevation similar to FIG. 5 and particularly depicting placement of a display card in juxtaposition to an article by the head of the transfer means as the article passes therebeneath on the conveyor belt.

With reference to FIGS. 1–3 there appear a plurality of tray holders 43. Each is preferably manufactured from plastic or other suitable material and is shaped to receive and hold approximately one-half of the article 21 to be packaged. The holder 43 is itself attached to a firm metal base 47 in a suitable manner and the bases 47 are in turn attached to two parallel chains 48 only one of which is shown. The two chains 48 with attached bases 47 and holders 43 form an endless conveyor belt 44 for passing the articles 21 through the apparatus 40 to be packaged. Four paired sprockets, 49 through 52, guide the chains 48 and each pair is mounted on an axle, 53 through 56 respectively, which passes from a rear or backing plate 58 to a front cover plate 59. To further support the conveyor belt 44, guide strips 131–132 and 133–134 may be fastened to the upper edge of plates 58 and 59 respectively, as depicted in FIGS. 5 and 6, providing narrow channels therebetween to receive the bases 47 attached to the chains 48.

The power to drive the conveyor belt 44 and holders 43 is derived from a motor (not shown) having a shaft 60 to which is attached a main drive sprocket 61 all of which are located behind the backing plate 58 forming part of the frame. A sprocket 63 is driven by sprocket 61 via chain 64 and is mounted on a shaft 65. Shaft 65 is journaled within a bearing (not shown) and passes through plate 58. Another sprocket mounted behind sprocket 63 drives another chain 66 to drive yet another sprocket 68 which is also mounted on a shaft 69, journaled within a bearing and passing through plate 58.

A bearing plate 70 is attached with bolts 71 to the plate 58 and provides support for the shaft 65 passing therethrough. A crank arm 72 is fitted over the end of shaft 65 and is fastened thereto with a bolt (not shown). A pitman arm 73 is attached to the opposite end of the crank 72 with a ball and socket joint 74 and includes a threaded portion 75 for lengthwise adjustment. Referring to FIG. 3, a sleeve 76 is shown slidably mounted on the end opposite of the joint 74 which is resiliently biased away from the joint 74 by a stiff compression spring 78. The spring 78 is adjusted between a nut and washer combination, 79 and 80, and the sleeve 76, the forward advancement of which is limited by nut 81. Two parallel pusher plates 82 are attached to the sleeve 76 with bolts 83.

Beneath the conveyor belt 44, a metal guide plate 84 is located which may be welded to bars 85 and 86 which extend between the plates 58 and 59. An elongated milled slot 88 passes between bars 85 and 86 in the lower half of guide plate 84. A link 89 is mounted on either side of the slot 88 with bolts 90 and 91 passing through roller spacers 92 and 93 respectively. The pusher plates 82 are fastened to the links 89 with a bolt 94, there being another roller 95 within the slot 88. A parallel set of drive fingers 98 are rotatably attached to the links 89 with the bolt 91, and wear plates 99 of nylon or similar material are positioned between the fingers 98 on either side of the guide plate, and are fastened to the fingers 98 with small screws 100.

All of the metal bases 47 are milled to slide over guide plate 84 and are provided with recesses 101 for the wear plates 99 and drive fingers 98. Movement of the conveyor belt with spaced holders is as follows. Rotation of sprocket 61 drives chain 64 and sprocket 63 which in turn causes the shaft 65 and crank arm 72 to rotate in a counter-clockwise fashion. As the pitman 73 is driven from its rearward position to its forward position, indicated in chain lines in FIG. 3, the links 89 and attached drive fingers 98 are urged linearly forward by the pusher plates 82. The wear plates 99 in turn push against the recess 101 and thereby urge a base 47 and overlying tray holder 43 in a forward direction, or to the left. Inasmuch as all of the bases 47 are fastened to the two chains 48, the entire conveyor belt 44 rotates about sprocket pairs 49–52 in a counter-clockwise fashion.

The forward advancement of the base 47 being driven is limited by a pair of pawls 102 which intermittantly engage a slot 103 in the base 47 in a manner hereinafter described in detail. The pawls 102 engage the slot 103 before the pusher plate 82 has been totally advanced by the pitman 73 and the excess movement of the pitman 73 is taken up by the compression spring 78. In like manner, when the pitman 73 is retracted by the crank arm 72 the spring 78 moves before the pusher plates 82 are withdrawn. This action is adjustably timed to maintain the tray holders 43 in a static position for a specific interval. The edge of each base 47, immediately forward of the slot 103 is machined at an angle so that the wear plates 99 may tip downwardly as they are withdrawn, the fingers 98 rotating a few degrees about the bolt 91. A small spring (not shown) urges the fingers 98 upwardly to engage the recess 101 of the next base 47 to advance it as the the pitman 73 again begins its forward throw.

As described above, the sprocket 68 is driven by the chain 66 from a sprocket behind sprocket 63. Another bearing plate 104 is attached with bolts 105 to the plate 62 and provides support for the shaft 69 passing therethrough. A face plate 106 may be fastened to the shaft 69 to facilitate mounting of a cam 108 onto the end of the shaft 69. A bolt 109 passes through the center of cam 108 and into the shaft 69. The cam 108 has an arcuate slot 110 milled therein and bolts 111 and 112 pass therethrough threadably engaging face plate 106. The cam 108 may therefore be rotatably adjusted about the shaft 69 and then locked with bolts 109, 111 and 112.

A cam follower 113 is carried between two prongs of an actuator rod 113 which is welded to a bar 115 extending from a flat plate 116. A bore is provided in the plate 116 for rotatably mounting it upon the axle 54 which in turn carries the sprocket paid 50 and passes between the rear and front plates 58 and 59. A similar plate 118 having a bore is also rotatably mounted by the axle 54 and carries a bar 119 to which is welded an elongated flat rod 120. The paired pawls 102, referred to above, are preferably bolted to the flat rod 120 and fit against either side of the guide plate 84 to ultimately engage the slot 103 in the base 47. A small diameter rod 121 having threaded ends for nuts 122 and 123 passes through the actuator rod 114 and the flat rod 120. The nuts 122 and 123 limit divergence between the two rods 114 and 120. Another small diameter rod 124 extends through a second bore in the actuator rod 114 and is held there by nuts 125 and 126. A compression spring 128 fits over the rod 124 and extends into a recess 129 in the overlying rod 120.

During advancement of the conveyor belt 44 the chain 66 is driven to rotate the cam 108. As the radius of the cam 108 increases, the follower 113 and actuator rod 114 are raised toward the tray holders 43 and the spring 128 transmits this upward movement to the rod 120 carrying the paired pawls 102. When the actuator rod 114 is at its highest position, the pawls 102 have been seated in the recess 103 on the underside of the base 47. As previously described, the drive finger 98 has simultaneously advanced the metal base 47 and the entire conveyor belt 44 to the position for engagement by the pawls 102. When the pawls 102 engage the base 47 movement of the entire conveyor belt 44 is interrupted and the various tray holders 43 are accurately positioned permitting the actual packaging operations to be performed as hereinafter described. Movement of the belt 44 remains temporarily interrupted, although the motor continues to run, and as the cam 108 continues to rotate and its radius decreases, the actuator rod 114 moves away from the overlying tray holder 43 simultaneously permitting the pawls 102 to withdraw and advancement of the conveyor belt 44 to resume as soon as the drive fingers 98 urge a subsequent tray holder 43 forward. A spring 130 may be employed to assure the quick withdrawal of the actuator rod 114 as shown in FIG. 3. For reasons of brevity, the foregoing operation shall be understood to occur as described and any particular traY holder 43 will therefore either be advancing or its movement will be temporarily interrupted.

The display card transfer mechanism 45 is also driven by the same motor which moves the conveyor belt 44. Referring to FIG. 2, the shaft 60 from the motor drives another sprocket (not shown) behind the sprocket 61. This sprocket is provided with a chain 150 which rotates another sprocket (not shown) and a shaft 151. The shaft 151 is journaled within a housing 152 which extends from a frame member 153 at the base of and connecting rear and front plates 58 and 59 respectively. Another sprocket (not shown) is mounted on shaft 151 and drives a chain 154, and a sprocket 155 mounted on a shaft 156. The sprocket 155 may be utilized to drive the display card transfer mechanism 45 in which event the mechanism 45 is mounted further toward the right end of the apparatus 40. In such position the mechanism 45 will deposit a display card 22 onto the tray holder 43, prior to placement of the article 21 thereon. The shaft 151 extends beyond the front plate 58 and carries a sprocket 158 which drives a chain 159 and a sprocket 160 mounted on a shaft 161. Sprockets 158 and 159 and the shaft 161 are outside of the front plate 58 and are generally protected by a guard 162, a portion of which is shown in FIG. 1.

Figure 4:
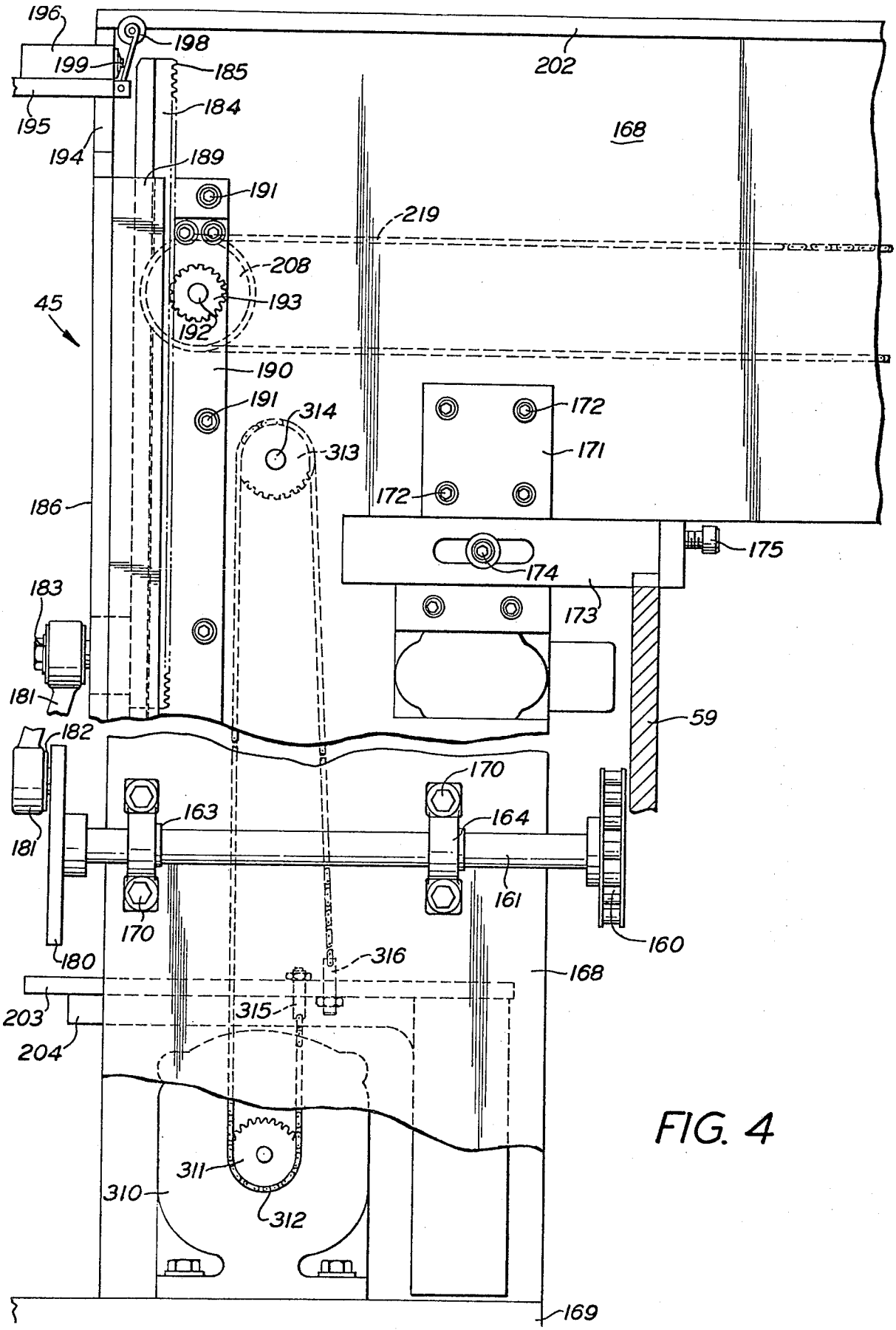
FIG. 4 is an enlarged side elevation taken substantially on line 4—4 of FIG. 1, depicting the rear side of the display card transfer means for moving a display card from a stack to the article.

Referring now to FIGS. 1 and 4, the shaft 161 is journaled within two bearings 163 and 164 which are attached to the side wall 168 of the frame 169 with bolts 170. The side wall 168 forming the main support structure for the display card transfer mechanism 45, extends over the conveyor belt 44 and is secured to the upper face of the apparatus 40. A plate 171 is fastened to side wall 168 with bolts 172 and a brace 173 joins the outboard or supply end of the side wall 168 to the front cover plate 59 with bolts 174 and 175.

The shaft 161 carries a crank arm 180 at the end opposite the drive sprocket 160. A pitman arm 181 is attached to the crank 180 with a ball and socket joint 182. Another ball and socket joint 183, connects the opposite end of the pitman 181 to a T-shaped rack 184 having a row of teeth 185 on the side opposite the connection with the pitman 181. A guide plate 186 having a longitudinal slot 188 therein is attached to the side wall 168 to direct the reciprocation of the rack 184 vertically.

The guide plate 186 is also provided with two angled members 189 (only one of which may be seen in FIG. 4) which together form a T-shaped channel to retain the rack 184 therein. A narrow spacer plate 190 is fastened to the side wall 168 with bolts 191 and houses a bearing for a shaft 192 provided with a pinion gear 193 which communicates with and is driven by the teeth 185 of the rack 184.

Extending outwardly from side wall 168 and above the guide plate 186 is a support 194 for a shelf 195. A micro air valve 196 is secured to the shelf 195 and is connected to a vacuum supply line (not shown). Through another line which exits from the valve 196, the vacuum is utilized to move the display cards 22. A switch 198 is pivotally mounted to the shelf 195 and is activated by the reciprocating rack 184. Thus, when the top of the rack 184 is below the switch 198, as depicted in FIG. 4, the vacuum from the supply line passes through the valve 196 and to the other line leading to the display card transfer mechanism 45. Whenever the rack 184 is driven into contact with the switch 198 and beyond, the switch moves against a plunger 199 which closes the valve 196 to the mechanism 45 cutting the vacuum thereto.

Figure 7:
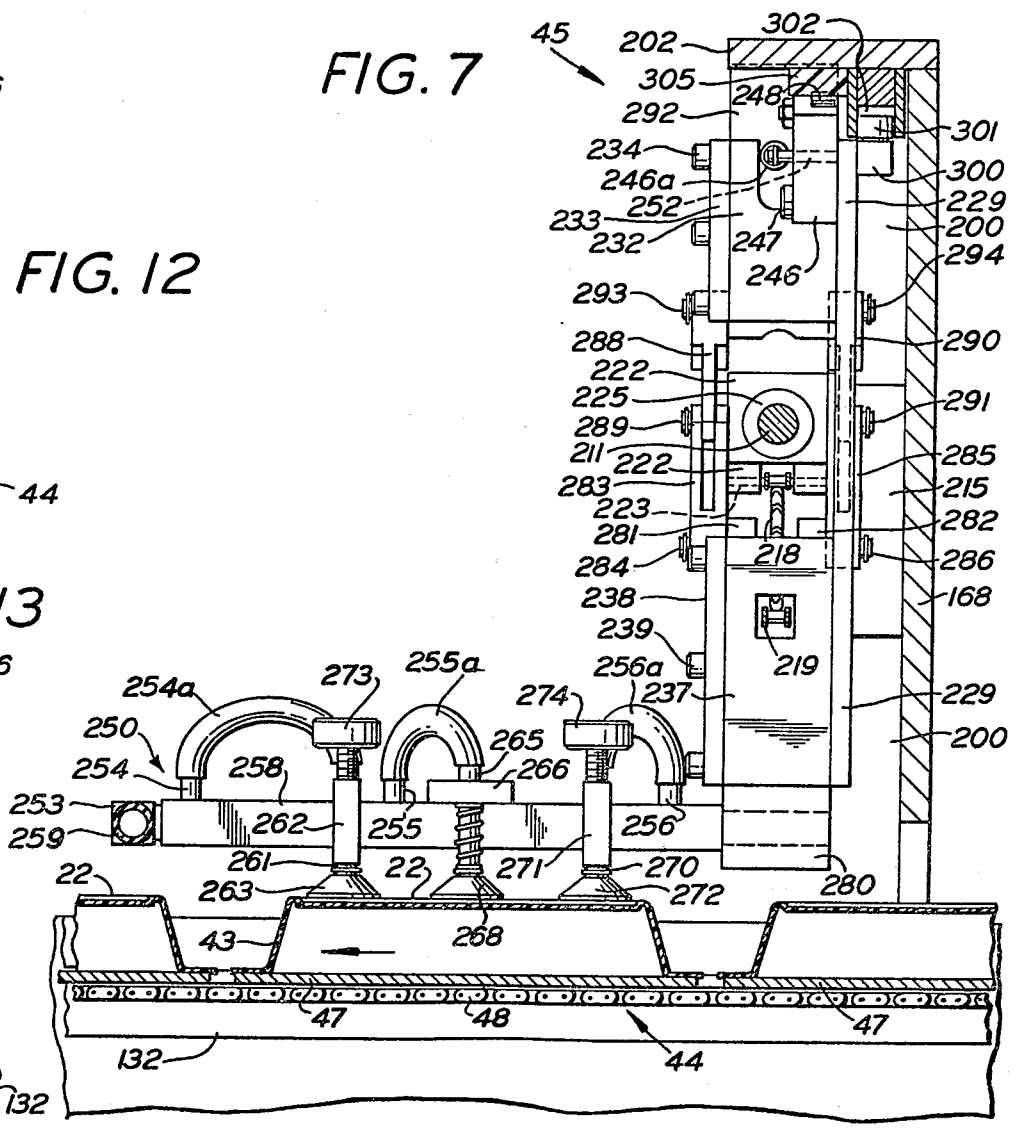
FIG. 7 is a frontal section taken substantially on line 7—7 of FIG. 6 again depicting the placement of a display card in juxtaposition to an article by the head of the transfer means.

Referring particularly to FIGS. 5–7, the components of the display card transfer mechanism 45 may be described. The side wall 168 which constitutes the chief support structure for the mechanism 45 is seen extending over the conveyor belt 44 wherein a tray holder 43 and article 21 are presented in position to receive a display card 22. The entire transfer mechanism structure may be joined to the existing portion of the apparatus 40 in any conventional manner and for the sake of clarity such joining structure has largely been eliminated. In addition to the guide 186, the side wall 168 also carries an end wall 200, a median wall 201 and a top wall 202.

A supply of display cards 22 is seen resting upon an adjustable tray and support frame, 203 and 204 respectively. An electric eye 205 may be mounted upon a bracket 206 attached to the median wall 201 for maintaining a constant level of display cards 22 as they are removed from the tray 203. The electric eye 205 regulates a supply motor the operation of which will be explained hereinbelow.

The shaft 192 to which the pinion gear 193 is attached on the opposite side of the side wall 168, extends therethrough and is provided with a drive sprocket 208. A bearing plate 209 is affixed to the wall 168 amd maintains the sprocket 208 at a proper distance therefrom. Immediately above the bearing plate 209 is a solid metal bumper block 210. A polished cylindrical guide rod 211 is housed at one end within the bumper block 210, at the outboard end of the mechanism 45, i.e., where the supply of display cards 22 lies, and extends over the conveyor belt 44 and tray holders 43 to the inboard end of the mechanism 45, i.e., where the display cards 22 are deposited over the articles 21. The inboard end of the guide rod 211 is housed within a similar solid metal bumper block 212. Solid rubber washers 213 and 214 surround both ends of the rod 211 at the bumper blocks 210 and 212 and serve as cushions. Beneath the inboard bumper block 212 is another bearing plate 215 for an axle 216 carrying a sprocket 218 for a chain 219 which is driven by sprocket 208.

As clearly depicted in FIG. 5, the chain 219 is not continuous but has two separate end links 220 and 221 which are attached to a slider block 222 by recessed machine screws 223 and 224. The slider block 222 fits over the guide rod 211 and is provided with a center of bearing material 225, as shown in FIG. 7, which actually contacts the guide rod 211. The guide rod 211 also passes through inboard and outboard slider blocks, 226 and 228 respectively, which also have a central lining of bearing material. Unlike the slider block 222, neither of the blocks 226 and 228 communicates with the chain 219 and both are fastened to a diamond-shaped carrier plate 229.

At the upper corner of the carrier plate 229, is mounted a hollow rectangular housing 230 comprising two side plates 231 and 232 and a cover plate 233 affixed thereto with screws 234. In a similar manner, at the lower corner of the carrier plate 229, is mounted another hollow rectangular housing 235 comprising two side plates 236 and 237 and a cover plate 238 affixed thereto with screws 239. A bore 240 in plate 236 and a bore 241 in plate 237 permits the lower half of the chain 219 to pass therethrough freely. A movable gate 242 is pivotally mounted on the carrier plate 229 adjacent the side plate 231 with a screw 243. The upper end of the gate 242 is provided with a roller 244 mounted thereon by a small nut and bolt 245. Another movable gate 246 is pivotally mounted on the carrier plate 229, with a screw 247, adjacent the side plate 231. The gate 246 also carries a roller 248 mounted thereto by a nut and bolt 249. A tension spring **246*a* is hooked between lugs 251 and 252, on gates 242 and 246, respectively, and serves to maintain the gates 242 and 246** drawn together i.e., in a closed position.

The display card transfer head 250 which picks up, transfers and deposits display cards 22 comprises an elongated hollow body element 258. An air line 259 which is connected to the micro valve 196 provides a vacuum supply to the body element 258 through aa suitable fitting 253. Three short pipes 254–256, extending from the top of the body element 258 transfer the vacuum through flexible tubes **254*a*, 255*a*, 256*a*. Tube 254*a* is connected to a hollow pipe 261 passing through a vertical cross member 262 which stradles the body element 258. The lower end of pipe 261 carries a vacuum cup 263. Tube 255*a* is connected to another hollow pipe 265 passing through a horizontal cross member 266 extending from the top of the body element 258. The pipe 265 also carries a vacuum cup 268 and a compression spring 269 is interposed around the pipe 265 between the cross member 266 and the vacuum cup 268. The tube 256*a* is connected to a hollow pipe 270 passing through another vertical cross member 271 straddling the body element 258. The lower end of the pipe 270 also carries a vacuum cup 272. Cross members 262 and 271 may be provided with hand screws, 273 and 274 respectively, so as to be laterally adjustable on body element 258 as shown in FIG. 7**.

It has been found that the display cards 22, when stacked, have a tendency to cling to each other usually resulting from rough edges about the cut out portion or opening 23 and tabs 26 and 28 of the cards 22. Also, some bowing of the stack, in an upward direction, may occur as a result of the scoring of tabs 26 and 28 to permit subsequent bending thereof when they are placed over an article 21. Both of these factors can cause inadvertent movement of more than one card 22 by the display card transfer head 250. To prevent this from occurring, the vertical cross members 262 and 271 are each provided with a blunt pin 264, as depicted in FIGS. 5 and 6. When the display card transfer head 250 descends upon the stack of cards 22, as explained below, the pins 275 flatten the stack and jar the top card 22 enough so as to free it from the card immediately below thereby causing only one card 22 to be removed therefrom. In FIG. 6, as the card 22 is deposited over the article 21, the pins 275 also help to flatten the card 22 against the tray holder 43.

As a further aid to preventing removal of more than one display card 22 at a time from the stack by the display card transfer head 250, small resilient fingers or combers (not shown) may be employed. These combers may be conveniently attached to the support frame 204 and generally extend over the card 22 and are downwardly directed thereover as by a spring. As the display card transfer head 250 removes a card 22, the combers pivot upwardly against the spring, seeking to hold the card. When the card 22 ultimately escapes the combers, they quickly snap down over the next card 22 thereby preventing it from being displaced.

The transfer head 250 is movable vertically over the display cards 22 and the conveyor belt 44, and the vacuum transmitted through vacuum cups 263, 268 and 272 enables the head 250 to hold a display card 22 until the vacuum is released. In order to move vertically, the transfer head 250, particularly the body element 258, is attached to a plunger 280 which is movable within the lower rectangular housing 235. The upper end of the plunger 280 has a front and a rear leg, 281 and 282 respectively, and is devoid of a central portion so as to clear the upper half of the chain 219 when the transfer head 250 is raised. The lower half of the plunger 280 is similarly hollow to clear the lower half of the chain 219. A front clevis rod 283 is pivotally attached to the front leg 281 of the plunger 280 with a pin and snap ring combination 284, and a rear clevis rod 285 is pivotally attached to the rear leg 282 of the plunger 280 with a pin and snap ring combination 286. A flat connecting rod 288 is pivotally connected to a pin 289 extending from the slider block 222 and held thereto with a snap ring. Another flat connecting rod 290 is pivotally held between the prongs of the rear clevis rod 285, both rods being pivotally connected to a pin 291 extending from the rear side of the slider block 222. A second plunger 292 is movable within the upper rectangular housing 230 and the free end of the connecting rod 288 is pivotally attached to the lower end of the plunger 292 with a pin and snap ring combination 293. Similarly, the free end of connecting rod 290 is pivotally attached to the lower end of the plunger 292 with a pin and snap ring combination 294. For purposes of simplicity the aforedescribed clevis rods, connecting rods and pins will be referred to collectively as the plunger linkage. It is the linkage which permits reciprocation of the plungers 280 and 292 within their housings, 235 and 230 respectively.

The entire transfer head 250 and carrier plate 229 reciprocates laterally as one structure between the inboard and outboard bumper blocks, 212 and 210 respectively. In order to maintain the carrier plate 229 in its vertical position on the guide rod 211, a small bracket 300 is mounted on the rear top side of the carrier plate 229, having a roller 301 thereon which moves within a channel 302 carried by the top wall 202.

At approximately both ends of the channel 302, the top wall is recessed, there being an inboard recess 303 and an outboard recess 304. The recesses 303 and 304 are provided as a clearance for extension of the upper plunger 292 therein when the gates 242 and 245 are opened, as will be described hereinbelow. Between the recesses 303 and 304 is a guard 305, preferably made of nylon or similar material, and attached directly adjacent the channel 302, above the gates 242 and 245, its purpose being to maintain both gates in a closed position.

Operation of the display card transfer mechanism 45 is as follows: When the rack 184 is on its upswing, the pinion 193 and drive sprocket 208 are rotated counterclockwise. Movement of the upper half of chain 219 is toward the inboard end which pulls the slider block 222, carrier plate 229, and transfer head 250 in that direction. As movement toward the inboard end continues along guide rod 211, the slider block 222 is adjacent the slider block 228 and the plungers 280 and 292 are in a retracted position as depicted in FIG. 5. In FIG. 7 the carrier plate 229 and transfer head 250 are at the inboard end, the slider block 226 has just contacted inboard bumper block 212 and lateral movement has ceased. As the sprocket 208 and chain 219 continue to move, the slider block 222 is drawn along the guide rod 211 towards the slider block 226. When the slider block 222 is midway between the blocks 226 and 228, the plunger linkage has pivoted from its folded position, depicted in FIG. 5, to a straight position whereby the plungers 280 and 292 are totally extended. The extension of the lower plunger 280 also lowers the transfer head 250 carrying a display card 22 directly over the tray holder 43 and an article 21 placed therein. At the exact moment that the display card 22 is positioned, movement of the conveyor belt 44 has been interrupted as described hereinabove. Also, the rack 184 has activated the switch 198, depressing the plunger 199 of the micro valve 196, releasing the vacuum to vacuum cups 263, 268 and 272 in order that the display card 22 will remain with the article 21 upon subsequent withdrawal of the transfer head 250.

Because of the guard 305, the lower plunger 280 cannot be extended until the upper plunger 292 is, which only occurs at the inboard and outboard ends, i.e., over the tray holder 43 and over the supply of display cards 22. The slider continues to be drawn away from the outboard block 228, folding the plunger linkage and retracting the plungers 280 and 292, until it contacts the inboard block 226. At this point, the plunger linkage is folded in the opposite direction than it appeared in FIG. 5, the transfer head 250 is elevated, the gates 242 and 246 are closed and the rack 184 can go no higher. Continued rotation of the crank arm 180 drives the pitman 181 and the rack 184 downwardly, thus reversing the direction of rotation of the pinion gear 193, the drive sprocket 208 and the chain 219. Now the slider block 222, carrier plate 229 and transfer head 250 are drawn towards the outboard end to pick up another display card 22. The rack 184 disengages the switch 198 and the vacuum is again supplied to the vacuum cups 263, 268 and 272.

When the outboard slider block 228 contacts the outboard bumper block 210 the carrier plate 229 ceases to move and the transfer head 250 descends upon the stack of display cards 22 due to the continued movement of the slider block 222, movement of the plunger linkage and of the plungers 280 and 292. After the transfer head 250 has removed a display card 22 and has been elevated, the rack 184 again reciprocates upwardly and the carrier plate 229 and transfer head 250 move toward the inboard end. Simultaneous with these movements, another tray holder 43 carrying an article 21 is advanced for receipt of the display card 22 thereon.

Since the transfer head 250 can only descend a fixed distance it is imperative that the upper level of display cards 22 remain relatively constant. To accomplish this, the electric eye 205 is focused over the correct level of display cards 22 and activates a supply motor 310, depicted in FIG. 4. The supply motor 310 drives a sprocket 311 and chain 312 mounted thereon, around an upper sprocket 313 carried by a shaft 314 extending from the end wall 168. The chain 312 is discontinuous and both ends are attached to threaded shafts 315 and 316 which are bolted to the adjustable tray 203. Counter-clockwise rotation of the sprocket 311 will elevate the tray 203 and display cards 22 until the electric eye 205 senses the correct level has been attained and deactivates the motor 310.

The label applying machine 41 is depicted in FIGS. 8–13. As stated above, this portion of the apparatus 40 may be derived from a conventional label applying machine which has been somewhat altered. Such a machine has its own source of power and drive mechanism (not shown) for vertical and horizontal reciprocation of the various components. The machine 41 is connected in a suitable manner to the mechanism 42 so that the labels 24 and 25 may be applied directly over the article 21 and display card 22, slightly downstream from the display card transfer mechanism 45.

The label machine 41 has a label pick up head 330, a label transfer head 331 and a label applicator 46. Linkage arms 333–335 raise and lower the pick up head 330 and the transfer head 331 as well as reciprocate both heads horizontally. The lowest arm 335 is connected to a base plate 336 which carries the pickup head 330 and the transfer head 331.

The label pick up head 330 consists of a metal frame 338 carrying pairs of suction cups 339 and 340. In its rearmost position, the pick up head 330 is positioned over stacks of labels 24 and 25 contained in holders, 341 and 342 respectively. When the base plate 336 is raised, the pickup head 330 removes two labels 24 and 25. Small combers (not shown) may be employed as described in conjunction with the display cards 22, to prevent the removal of more than one label from a holder at a time. The plate 336 is then moved horizontally forward and then lowered so that the labels 24 and 25 are deposited in a preforming tray 342. The preforming tray 342, depicted in FIGS. 10 and 11 has a wide flat bottom surface 343 and two side walls 344 and 345 extending therefrom at an angle greater than ninety degrees. A plurality of air passages 346 pass through the bottom surface 343 of the tray 342 and are connected to a vacuum supply (not shown) which removes the labels 24 and 25 from the pickup head 330.

The label transfer head 331 consists of a hollow frame 348 carried by the base plate 336 and provided with a vacuum supply via a tube 349. The underside of the frame 348 has a label forming plate 350 having a configuration complimentary to that of the tray 342. A plurality of air passages 351 pass through the plate 350 communicating with the subatmospheric pressure within the hollow frame 348. When the base plate 336 has retracted to its rearmost position, and the pickup head 330 contacts two new labels 24 and 25, the transfer head 331 and particularly the forming plate 350 is brought down onto the preforming tray 342 creasing at least one of the labels 25 at both ends 33 and 34.

Figure 11:
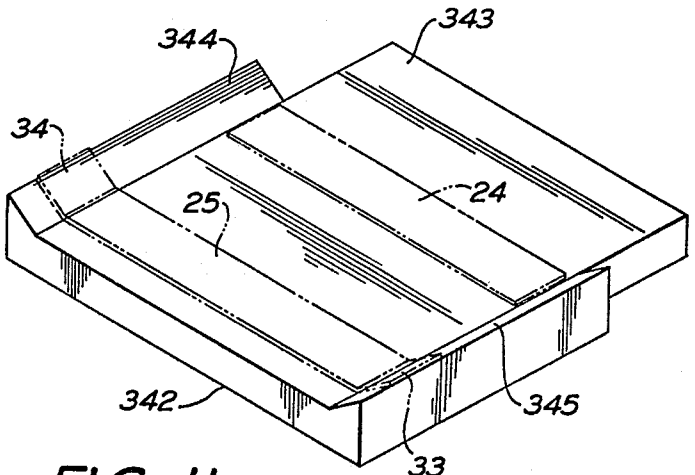
FIG. 11 is a perspective view depicting two labels on the preforming plate one of which has been preformed.
Figure 10:
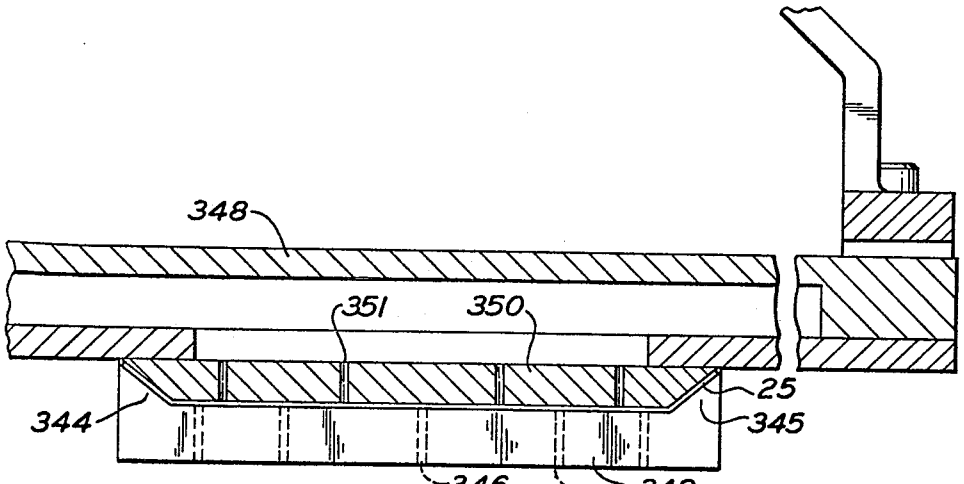
FIG. 10 is a vertical section taken substantially on line 10—10 of FIG. 8 depicting the forming of at least one label between the preforming plate and the label transfer head.

While the use of two labels has been found to be advantageous, some packages may require only one. Moreover, none of the labels or all of the labels may be preformed for subsequent deposit upon the article 21 and display card 22. In the preferred embodiment, one of the labels 24, depicted in phantom in FIG. 11, is shorter than the label 25 (also in phantom) and is therefore not preformed. Inasmuch as the machine 41 is basically a dry labelling variety, the labels utilized have a heat sensitive adhesive coating, and the transfer head 331 is therefore heated so the label forming plate 350 may activate the adhesive.

Figure 9:
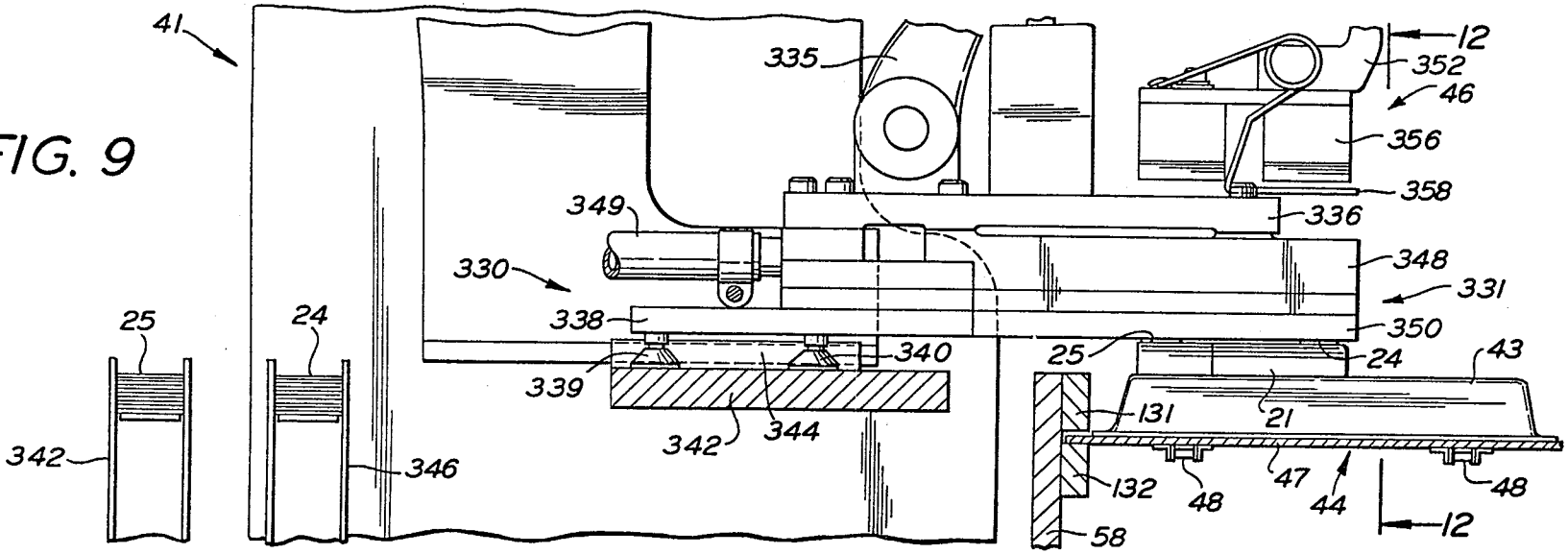
FIG. 9 is a side elevation of the labelling machine depicted in FIG. 8 further depicting the simultaneous operations performed by the label pick up head and the label transfer head in their forward position, and the retracted position of the label applicator.

When the base plate 336 is again raised, the vacuum applied through the preforming tray 342 is either reduced or cut off so that the vacuum applied through the label forming plate 350 is able to remove both labels 24 and 25. As the base plate 336 advances forwardly, heat from the transfer head 331 activates the adhesive coating applied to labels 24 and 25 which are carried with the adhesive side down. When the base plate 336 again descends, two new labels are deposited in the preforming tray 342 while the two preformed, heated labels 24 and 25 are applied directly to the article 21 as depicted in FIG. 9. It is at this point of time that movement of the conveyor belt 44 has temporarily ceased in the manner described hereinabove. The adhesion between the labels 24 and 25 and the article 21 is sufficient to overcome the vacuum applied through the label forming plate 350 and as the base plate 336 is withdrawn, the labels 24 and 25 remain.

Figure 12:
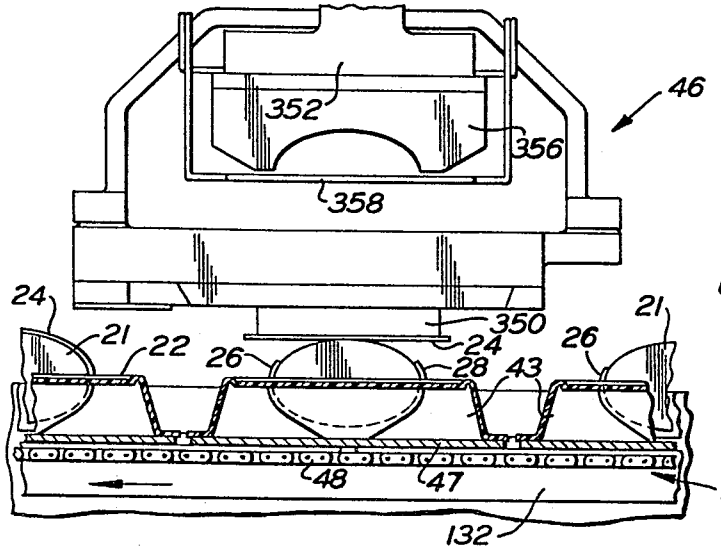
FIG. 12 is an enlarged front elevation taken substantially on line 12—12 of FIG. 9 depicting application of a label to an article by the label transfer head, said FIG. 12 appearing on the same sheet of drawings as FIG. 7.
Figure 13:
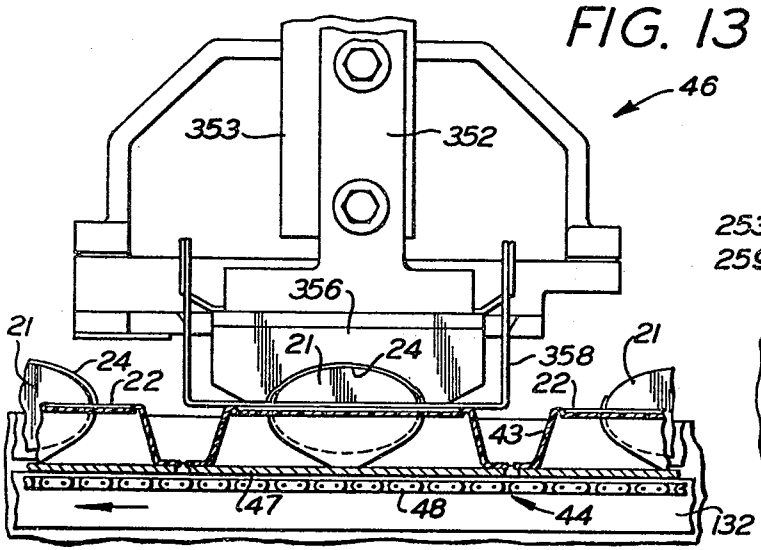
FIG. 13 is an enlarged front elevation taken substantially on line 13—13 of FIG. 8 similar to FIG. 12, depicting application of the label to an article and a display card, the label transfer head having been withdrawn rearwardly.
Figure 8:
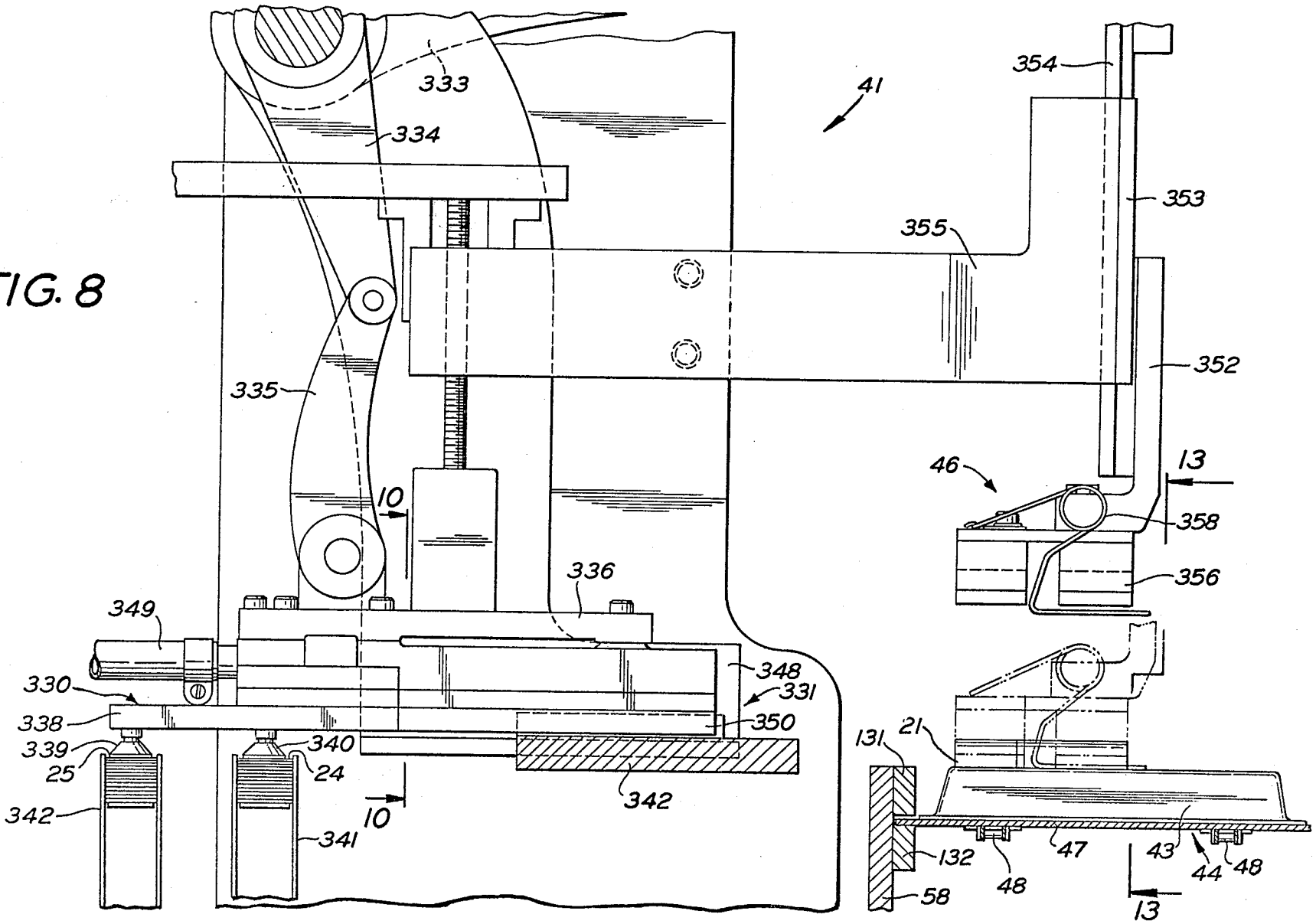
FIG. 8 is a side elevation of a labelling machine, adapted for use with the apparatus, depicting the simultaneous operations performed by the label pick up head and the label transfer head in their rearward position, and by the label applicator.

The label applicator 46 is positioned above the conveyor belt 44 as depicted in FIG. 12. It consists of a vertically disposed arm 352 connected to a movable support 353 which slides vertically with respect to a frame member 354 which is in turn connected to a pair of lateral supports 355. The base of the arm 352 carries the head 356 of the label applicator 46 which is formed of a generally flexible material such as rubber or plastic and which has a concave underside contoured to fit over the article 21. As depicted in FIGS. 8, 12, and 13, after the label transfer head 331 has deposited labels 24 and 25 over the article 21 (FIG. 12) it is withdrawn rearwardly and the label applicator 46 affixes both labels 24 and 25 to the article and display card 22, with one rapid downward stroke before the conveyor belt 44 begins to advance. A wire spring 358 is carried by the head 356 which becomes biased against the display card 22 when the label applicator 46 is fully descended. The spring maintains the complete package 20 within the tray holder 43 as the applicator 46 is withdrawn thereby eliminating any premature displacement of the package 20 therefrom.

Simultaneous with the upstroke of the label applicator 46, the conveyor belt 44 again advances bringing another article 21 and display card 22 thereunder for labelling. As the conveyor belt 44 eventually passes around the sprocket pair 50, the package 20 falls from the tray holder 43 and may be removed from the apparatus 40, via a conveyor 359, to another location.

Figure 14:
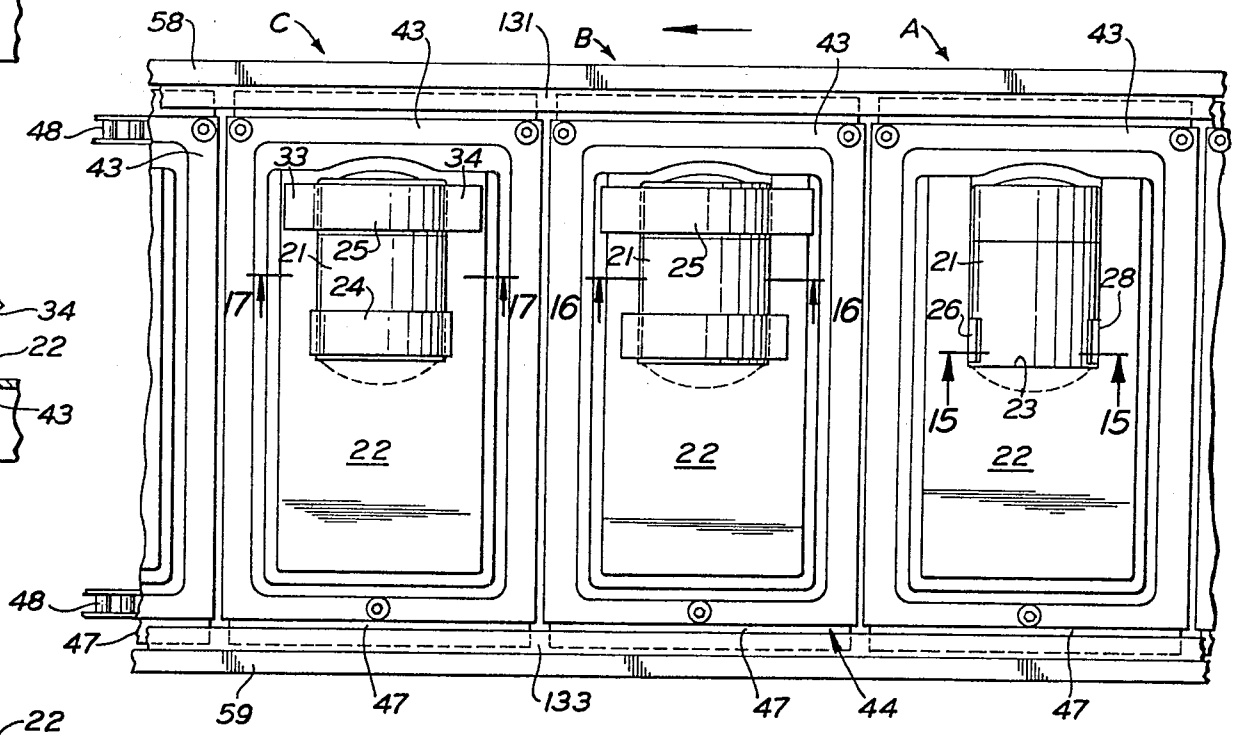
FIG. 14 is a top plan of a portion of the conveyor belt depicting three articles and display cards upon spaced trays and further depicting sequential application of the labels thereto.
Figure 15:
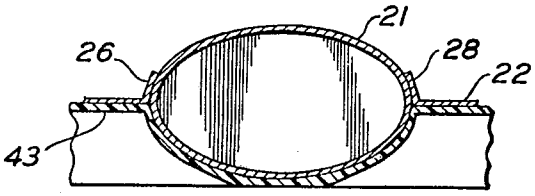
FIG. 15 is an enlarged vertical section taken substantially on line 15—15 of FIG. 14, depicting an article within a tray carried by the conveyor belt and having a display card placed thereover.

FIG. 14 depicts sequentially the three operations that are concurrently preformed by the apparatus 40 pursuant to the preferred method. As the empty tray holders 43 pass before an operator, an article 21 is placed therein. At the exact moment that movement of the conveyor belt is interrupted, the display card transfer mechanism 45 places a display card 22 over the article 21 as in position A and FIG. 15. The cut out portion 23 fits over the article 21 and the tabs 26 and 28 are bent upwardly. While only two such tabs are illustrated, it is to be remembered that the number, size and position thereof may be varied according to the specific requirements of the particular article and display card being used. Thus, the tabs 26 and 28 could extend along the entire side of the article 21 or, other tabs could be utilized to support for example, the base of the article 21. Moreover, a solid display card may be utilized and if desired, the card may be transferred to a holder initially and an article placed thereon.

Figure 16:
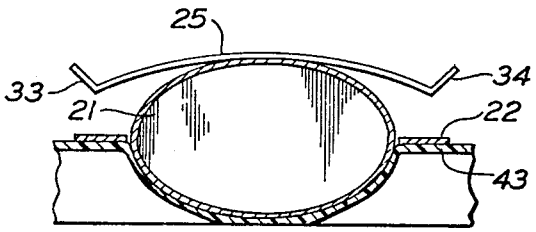
FIG. 16 is an enlarged vertical section taken substantially on line 16—16 of FIG. 14 similar to FIG. 15, and depicting a label as applied to the article.
Figure 17:
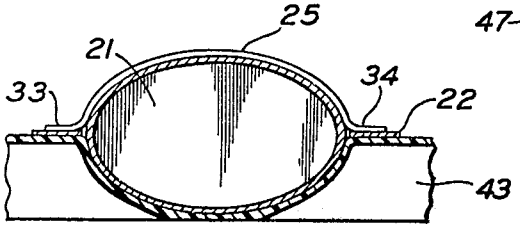
FIG. 17 is an enlarged vertical section taken substantially on line 17—17 of FIG. 14, similar to FIGS. 15 and 16 and depicting final application of a label to the article and the display card.

Further downstream from the transfer mechanism 45, and before the conveyor belt 44 resumes movement, at position B, the label transfer head 331 deposits two heated labels 24 and 25, label 25 being preformed as in FIG. 16, over the article 21. While the transfer head 331 is retracting, the label applicator 46 permanently affixes the labels 24 and 25 to the article 21 and display card 22 without webbing the label 25 therebetween as in FIG. 17. Although position C appears adjacent and to the left of position B, such is the case merely for purposes of illustration. During the actual operation, the transfer head 331 retracts and the label applicator 46 acts in rapid succession, before the conveyor belt 44 resumes movement.

As the conveyor belt 44 again resumes movement, the display card transfer mechanism 45 picks up another display card 22 and two more labels 24 and 25 are prepared for application during the subsequent cycle. By substituting different tray holders for the holders 43 and making other minor adjustments, a variety of different sizes and shapes of articles, display cards and labels may be combined to form display packages with the apparatus and method embodying the concept of the present invention.

We claim:

1. A method for packaging articles with a display card generally larger than the article and having a cutout portion therein and at least one tab contiguous therewith, comprising the steps of:

placing the article and display card upon a movable belt;

urging at least one tab away from the plane of the display card by movement of the article relative to the display card whereby the article extends partially through the cutout portion and contacts the tab;

advancing the card and article to a position for the application of a means for joining the article to the card;

moving at least one of said joining means into juxtaposition with the article and card; and, affixing the article to the card by applying said joining means to the article and at least one tab.

2. A method for packaging articles, as set forth in claim 1 including the further steps of:

supplying at least one said joining means to a means for preforming;

creasing opposing ends of said joining means therein;

removing said creased joining means from said means for preforming and into juxtaposition with the article and the card; and, applying said creased joining means to the article and the card so that said opposing ends totally contact the card.

3. A method for packaging articles, as set forth in claim 1, wherein the step of placing the article and card upon said movable belt is facilitated by intermittantly terminating movement of said belt to allow deposition of the card onto the article.

4. A method for packaging articles, as set forth in claim 3, in which deposition of the card onto the article is accomplished by withdrawing the card from a first position, translating the card to a second position in juxtaposition to said belt, and releasing the card thereover.

5. A method for packaging articles, as set forth in claim 4, wherein the card is withdrawn and translated by means of a pressure differential.

6. A method for packaging articles, as set forth in claim 2, in which the step of creasing said joining means is accomplished by shaping said joining means between a tray and a plate.

* * * * *